US010450128B2

(12) United States Patent
Hung et al.

(10) Patent No.: US 10,450,128 B2
(45) Date of Patent: Oct. 22, 2019

(54) NESTING PACKAGING DESIGN FOR PLANTERS

(71) Applicant: ATT Southern, Inc., Camp Hill, PA (US)

(72) Inventors: Chun Hung, Dillsburg, PA (US); Brian Leahy, Atlanta, GA (US); Patrick Guillory, Smyrna, GA (US); Phillip Lemke, Schuylkill Haven, PA (US); John Carpenter, Camp Hill, PA (US)

(73) Assignee: ATT Southern, Inc., Camp Hill, PA (US)

( * ) Notice: Subject to any disclaimer, the term of this patent is extended or adjusted under 35 U.S.C. 154(b) by 77 days.

(21) Appl. No.: 15/615,317

(22) Filed: Jun. 6, 2017

(65) Prior Publication Data

US 2017/0349367 A1 Dec. 7, 2017

Related U.S. Application Data

(63) Continuation of application No. 29/567,117, filed on Jun. 6, 2016, now Pat. No. Des. 837,094, and a (Continued)

(51) Int. Cl.
*B65D 85/62* (2006.01)
*B65D 5/42* (2006.01)
(Continued)

(52) U.S. Cl.
CPC ..... *B65D 85/62* (2013.01); *B65D 5/42* (2013.01); *B65D 5/5019* (2013.01); *B65D 5/5021* (2013.01)

(58) Field of Classification Search
CPC ..... B65D 5/42; B65D 5/5019; B65D 5/2021; B65D 85/62; B65D 85/321;
(Continued)

(56) References Cited

U.S. PATENT DOCUMENTS 1,059,359 A * 4/1913 Hahn ..... B65D 85/321 206/500
1,116,694 A 11/1914 Hahn
(Continued)

*Primary Examiner* — Christopher R Demeree
(74) *Attorney, Agent, or Firm* — Brooks Kushman P.C.

(57) ABSTRACT

A planter packaging arrangement is disclosed that comprises a packaging element and at least one planter mounter therein. The packaging element includes a bottom surface, a top surface and two pairs of opposing side walls collectively defining a generally enclosed space. A first opening is defined through the top surface and aligned with a second opening defined through the bottom surface of the packaging element. The at least one planter is mounted within the packaging element, with an open top end disposed within the enclosed space of the packaging element. The second opening is aligned with the open top end such that an interior of the planter is accessible through the second opening of the bottom surface of the packaging element. A portion of the body portion extends through the first opening of the top surface of the packaging element such that the bottom surface is disposed above the top surface.

19 Claims, 11 Drawing Sheets

Related U.S. Application Data continuation of application No. 29/586,077, filed on Nov. 30, 2016.

(60) Provisional application No. 62/346,202, filed on Jun. 6, 2016.

(51) Int. Cl.
*B65D 5/50* (2006.01)
*B65B 25/02* (2006.01)

(58) Field of Classification Search
CPC ..... B65D 21/0209; B65D 21/0233; B65D 2571/00895; B65D 5/001; B65D 77/0433
USPC ..... 229/175, 915; 206/423, 499; D11/143; 47/84, 901; 211/126.1
See application file for complete search history.

(56) References Cited

U.S. PATENT DOCUMENTS 3,414,132 A 12/1968 Comu
D232,753 S 9/1974 Jalakas
D238,088 S 12/1975 Grosfillex
5,141,149 A * 8/1992 Fulton ..... B65D 5/003 206/423
D340,204 S 10/1993 Grosfillex
D376,769 S 12/1996 Kreidler
D392,914 S 3/1998 Friend
D399,456 S 10/1998 Weder
D428,360 S 7/2000 Herzog-Mesrobian
D438,487 S 3/2001 Madden
6,422,390 B1 * 7/2002 Humphrey ..... B65D 85/42 206/421
6,516,563 B1 2/2003 Matthews
D480,326 S 10/2003 Carlson
D491,061 S 6/2004 Bouroullec
D532,715 S 11/2006 Schmidt
7,140,149 B2 11/2006 Searle et al.
D570,245 S 6/2008 McAbee
D571,688 S 6/2008 White
D686,913 S 7/2013 Kirk
D688,589 S 8/2013 Hung et al.
D689,793 S * 9/2013 Yung ..... D11/143
D702,548 S 4/2014 Flury
D724,481 S 3/2015 Blouin
8,985,329 B2 3/2015 Ulrich
D745,428 S 12/2015 Morris
D763,105 S 8/2016 Forowycz
9,586,739 B2 * 3/2017 Jego ..... B65B 5/024
D801,213 S 10/2017 Kim
2005/0072704 A1 4/2005 Patz et al.
2013/0036669 A1 2/2013 Rabii

* cited by examiner

NESTING PACKAGING DESIGN FOR PLANTERS

CROSS-REFERENCE TO RELATED APPLICATIONS

This application claims the benefit of U.S. provisional application Ser. No. 62/346,202 filed Jun. 6, 2016. This application is a continuation of U.S. Design application No. 29/567,117, filed Jun. 6, 2016, now U.S. Pat. No. Design 837,094, and U.S. Design application No. 29/586,077, filed Nov. 30, 2016, the disclosures of which are hereby incorporated in their entirety by reference herein.

TECHNICAL FIELD

The present disclosure relates generally to a product packaging arrangement for planters.

BACKGROUND

Packaging for planters for transport and storage present certain challenges. For example, planters have open top end and are typically tapered inward toward a substantially closed bottom surface. To package the planters effectively for transport and storage, each planter is traditionally individually packaged in a closed box. However, such arrangements result in significant bulk, much of the interior of the box including wasted space. Thus more transport space is needed to transport traditionally boxed planters, thereby increasing costs for transporting such planters. Moreover, the boxes do not secure together, thus may be susceptible to moving or falling over during transport. Further, storage of the traditionally boxed planters is also an issue. Individually boxed planters take up significant space.

Another issue is that the planters are not visible to the end consumer in traditionally boxed arrangements. Either marketing images need to be positioned on the exterior of the box or each box must be opened and the planter taken out at a point of purchase display. Either option increases costs.

What is needed is a planter packing arrangement that provides more efficient space management for both transport and storage, as well as providing visibility of the planter to the end consumer.

SUMMARY

A first exemplary configuration of a planter packaging arrangement comprises a packaging element and at least one planter. The packaging element is defined by a first element and a second element. The first element is defined by a bottom surface, and two pairs of opposing side walls that extend upwardly from the bottom surface and define a generally open top surface, the bottom surface further defines a first opening therethrough. The second element is defined by a top surface and two pairs of opposing side walls that extend downwardly from the top surface and define a generally open bottom surface, the top surface further defines a second opening therethrough. The at least one planter is mounted within the first element, the planter defined by a bottom surface, an open top end and a body portion therebetween.

The open top end of the at least one planter is disposed within the first element of the packaging element with the open top end of the at least one planter being aligned with the first opening such that an interior of the at least one planter is accessible through the first opening of the bottom surface of the first packaging element. The second element is connected to the first element such that a portion of the body portion of the at least one planer extends through the second opening of the top surface of the packaging element such that the bottom surface of the at least one planter is disposed above the top surface of the second packaging element.

In a second exemplary, a planter packaging arrangement comprises a unitary packaging element defined by a first element and a second element joined together by a sidewall member. The first element has a first opening and the second element has a second opening. At least one planter is mounted within the first opening, the planter defined by a bottom surface, an open top end and a body portion therebetween. The second element of the packaging element is selectively pivotable about the side wall member such that the first element is parallel to the second element and the second opening is aligned with the open top end of the at least one planter such that an interior of the at least one planter is accessible through the second opening of the packaging element. The second element is connected to the first element to capture the open top end of the at least one planter within an interior defined by the packaging element.

DETAILED DESCRIPTION

Figure 1:
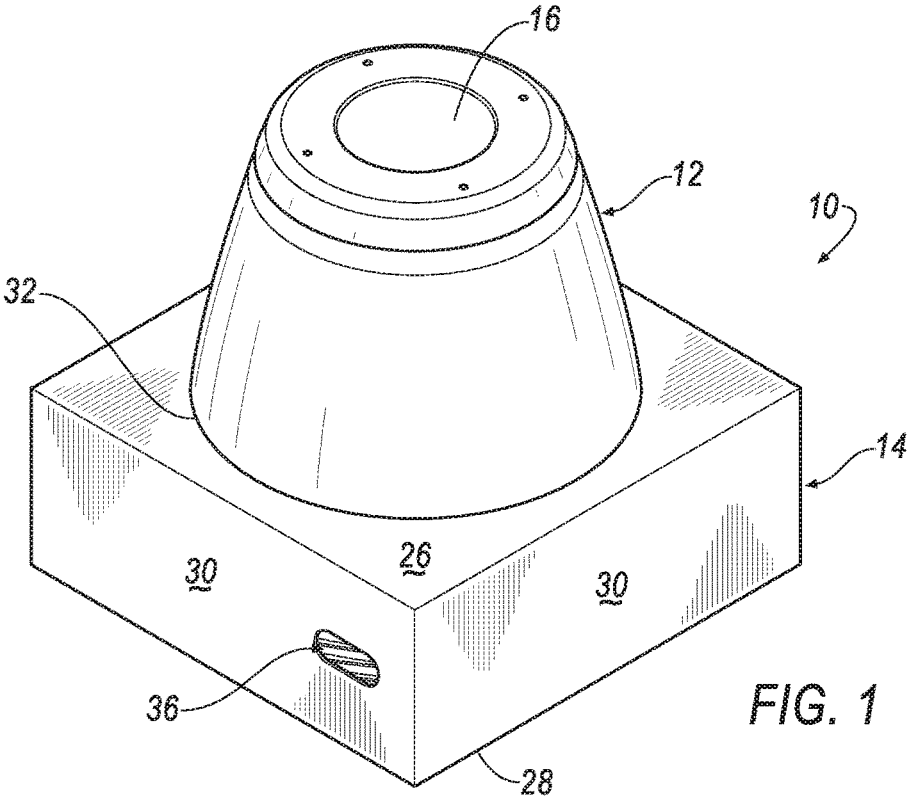
FIG. 1 is a top perspective view of an individual planter packaging arrangement.

Referring now to the drawings, illustrative examples are shown in detail. Although the drawings represent certain examples of the disclosure, the drawings are not necessarily to scale and certain features may be exaggerated to better illustrate and explain an innovative aspect of an example. Further, the examples described herein are not intended to be exhaustive or otherwise limiting to the precise form and configuration shown in the drawings and disclosed herein.

Referring to FIGS. 1-5, an individual planter packaging arrangement 10 is shown. The individual planter packaging arrangement 10 includes a planter 12 partially mounted in a packaging element 14. The planter 12 is defined by a generally closed bottom surface 16, a top edge 18 (shown in phantom in FIG. 3) extending around an open top end 20 and a body portion 22 extending between the bottom surface 16 and the open top end 20. The bottom surface 16 is configured with a cross-sectional area that is smaller than a cross-sectional area of the open top end 20. In this manner, the body portion 22 flares or tapers outwardly from the bottom surface 16 to the open top end 20. In one arrangement, the body portion 22 further includes an outer rim element 24 disposed on an outer surface of the body portion 22 that extends from open top end 20. Alternatively, the top edge 18 may flare outwardly from the body portion 22, similar to a bell.

The packaging element 14 is defined by spaced apart generally opposing top 26 and bottom 28 surfaces that are joined together by four sidewalls 30. In one exemplary arrangement, portions of the sidewalls 30 may be integral with the top 26 and bottom 28 portions. The top surface 26 includes a first opening 32 disposed therethrough. The bottom surface 28 includes a second opening 34 disposed therethrough. The first and second openings 32, 34 are generally aligned such that a central axis extends through a center of both first and second openings 32, 34. However, as will be explained in further detail below, the first opening 32 has a first diameter that is smaller than a second diameter of the second opening 34.

In one exemplary arrangement, opposing sidewalls 30 may be configured with one or more grasping elements 36. In one exemplary arrangement the grasping element 36 is configured as a deformable portion 38 of the sidewall 30. More specifically, sides 40 and bottom edge 42 of deformable portion 38 may be perforated such that a force exerted onto the deformable portion 38 will permit a portion of the sidewall 30 to be forced toward an interior of the packaging element 14, pivoting about a top edge 44 of the deformable portion 38 to create an opening 46 into which fingers or a part of a hand may extend to grasp the packaging element 14.

It is understood, however, that the disclosure is not restricted to this particular arrangement and that either one of the sides 40 or the bottom edge 42 may remain unperforated and the top edge 44 may be perforated to still allow the deformable portion 38 to be forced toward the interior of the packaging element 14. As yet another alternative, the bottom edge 42, top edge 44 and side edges 40 may all be perforated and any force exerted on to the deformable portion 38 allows the deformable portion 38 to break away from the sidewall 30 to define the openings 46. As yet another exemplary arrangement, the sidewalls 30 may simply be provided with the openings 46. While the arrangement shown in the drawings illustrate that the grasping elements are formed on two opposing sidewalls 30, it is also contemplated that all four side walls may be provided with the grasping elements.

Figure 2:
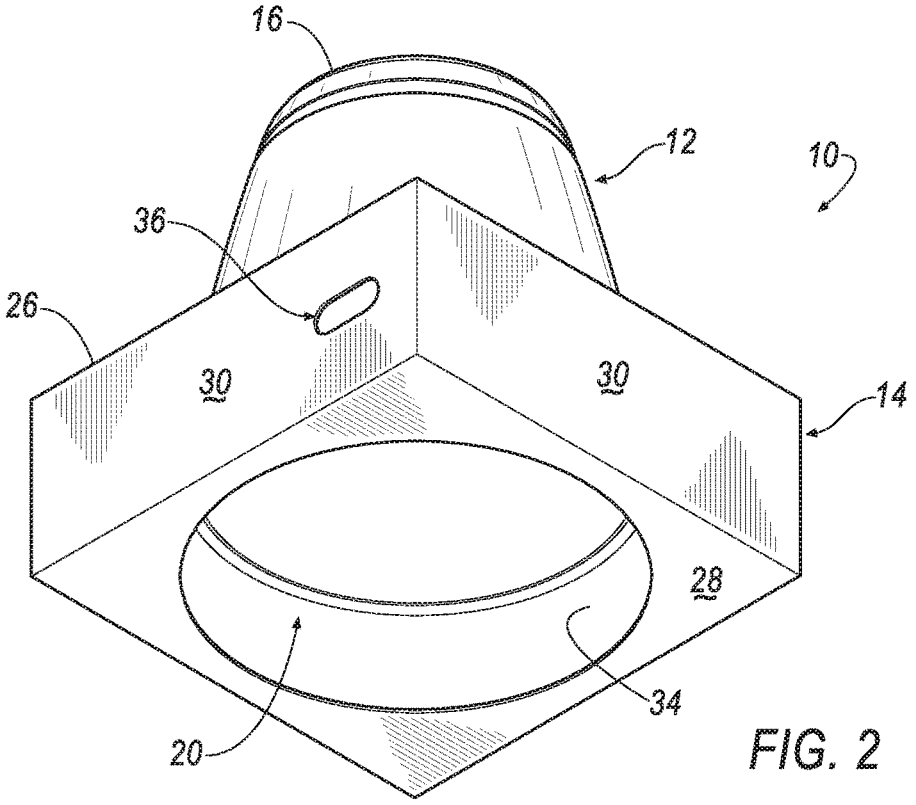
FIG. 2 is a bottom perspective view of the individual planter packaging arrangement of FIG. 1.
Figure 3:
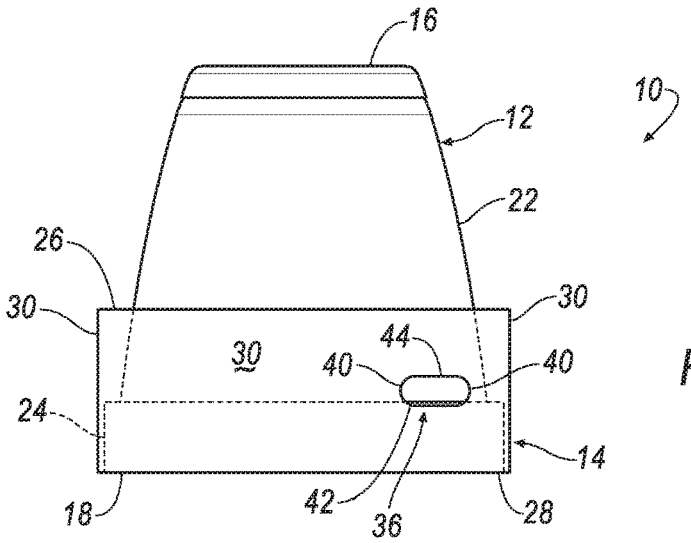
FIG. 3 is an elevational view of the individual planter packaging arrangement of FIG. 1.
Figure 4:
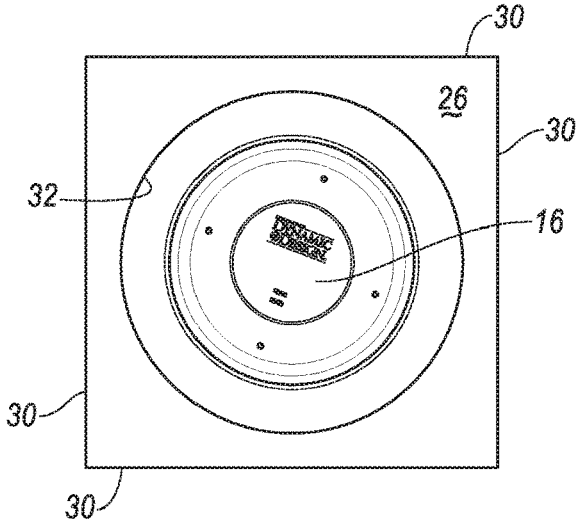
FIG. 4 is a top plan view of the individual planter packaging arrangement of FIG. 1.
Figure 5:
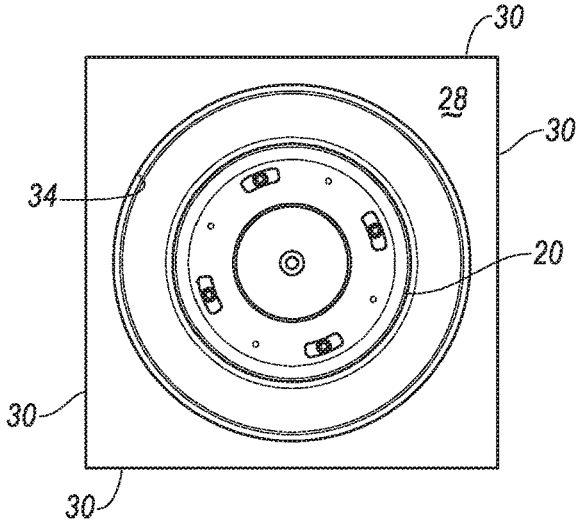
FIG. 5 is a bottom plan view of the individual planter packaging arrangement of FIG. 1.

The planter 12 is mounted within the packaging element 14. In one exemplary arrangement, the bottom surface 28 may be pivoted away from the top surface 26 and the planter 12, due to a fold line 41 that serves as a hinge. The bottom surface 28 is turned upside down from its normal use configuration and the bottom surface 16 of the planter 12 is inserted through the first opening 32. The first opening 32 will serve as a stop to retain a portion, i.e., the top edge 18, of the planter 12 beneath the top surface 26. Once the bottom surface 16 has been inserted through the first opening 32, the bottom surface 28 may be pivoted back along fold line 41 so as to oppose the first surface 26 and the sidewalls 30 are connected between the top 26 and bottom 28 surfaces by any suitable manner, thereby capturing the top edge 18 of the planter 12 within the interior of the packaging element 14, as shown in FIG. 2. The second opening 34 will be disposed beneath the open top end 20 of the planter 12. In one exemplary arrangement, the second opening 34 is sized to be slightly smaller than the open top end 20, such that the top edge 18 may rest on the bottom surface 28 in the interior of the packaging element 14.

In one exemplary arrangement, a stabilizing element (not shown) may be provided within the interior of the packaging element 14. The stabilizing element may take the form of a Styrofoam ring. The ring may be disposed over the bottom surface 16 of the planter 12 and have a thickness to substantially fill the empty space within the interior of the packaging element 14 and prevent unwanted movement of the planter 12 within the interior of the packaging element 14.

Instead of a Styrofoam ring, the stabilizing element may include a top surface having an opening that corresponds to the first opening 32 of the packaging element 14, two opposing sidewalls integrally attached to the top surface of the stabilizing element and to a bottom surface that includes an opening that corresponds to the second opening 34. The remaining sides are open.

Figure 6:
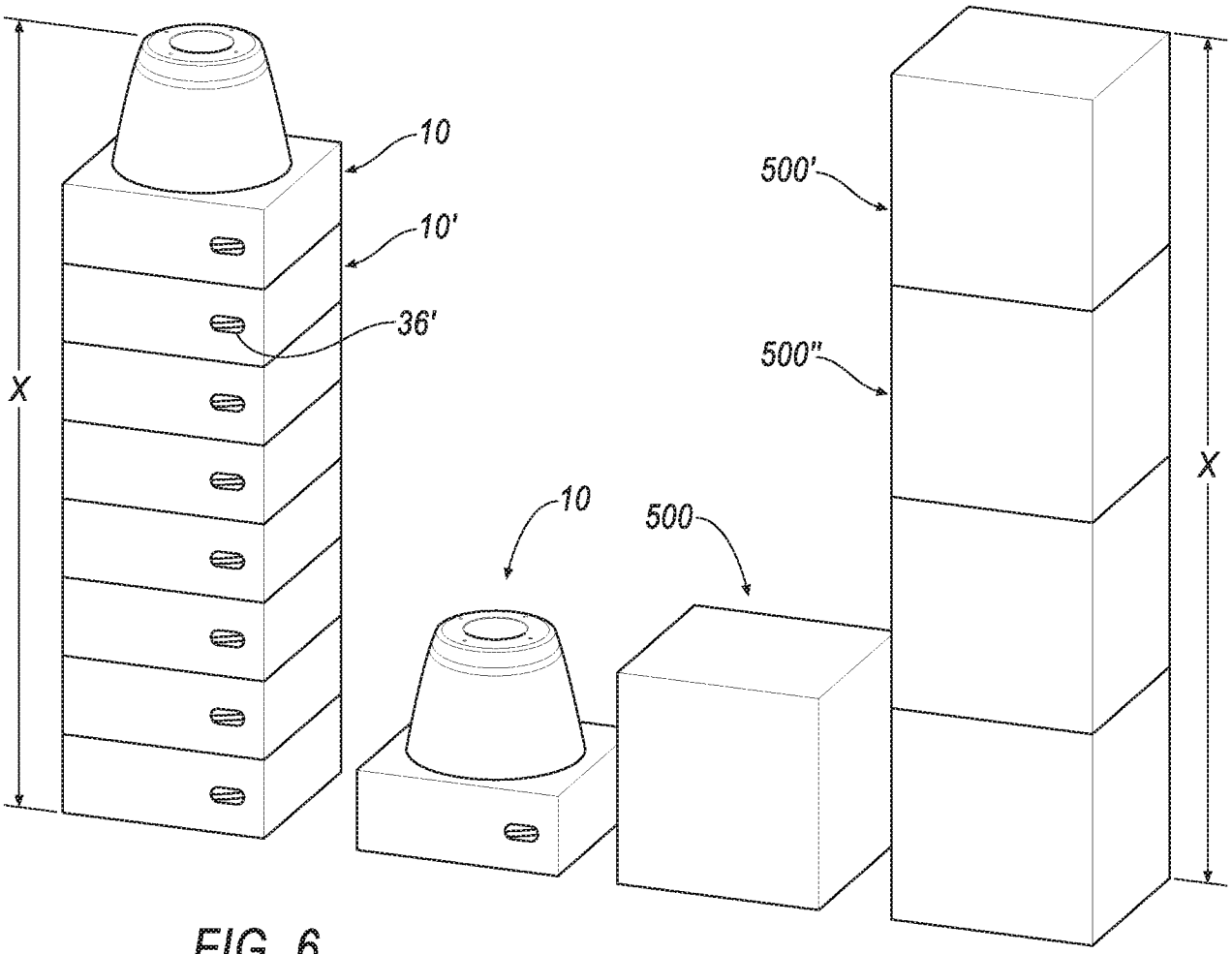
FIG. 6 is a perspective view of a stack of the individual planter packaging arrangement of FIG. 1, compared with a stack of traditional individual planter packaging arrangements.

The planter packaging arrangement 10 permits selective stacking of successive planters 12 in a much more compact manner than traditional packaging arrangements. As shown in FIG. 6, a first individual planter packaging arrangement 10 is disposed over a second individual planter packaging arrangement 10'. The bottom surface of the planter 12 for the second individual planter packaging arrangement 10' extends through the second opening 34 of the first individual planter packaging arrangement 10 to nest within the body portion 22 of the planter 12 of the first individual planter packaging arrangement 10, as demonstrated in FIG. 6. As may be seen, additional planter packaging arrangements may be stacked together to create a column.

For comparison purposes, as shown in FIG. 6, the individual planter packaging arrangements 10/10' are shown stacked together, adjacent to a traditional individual planter packaging 500 for a ceramic planter. Traditional individual planter packaging 500 is configured to only accommodate a single planter 12. A series of four traditional individual planter packaging 500 are stacked in a successive manner on the right portion of the FIG. 6, which yields a height of X.

However, as shown in the left side of FIG. 6, using the individual planter packaging arrangements 10/10', a stack at a height of X may include 8 individual planter packaging arrangements 10/10'. Moreover, unlike the traditional individual packaging, the successive units are secured together, reducing the likelihood of the packaging falling over when stored on a shelf or when physically transporting a series of the individual planter packaging arrangements 10/10'.

Further, the grasping elements 36 facilitate easy removal and transport of a stack of individual planter packaging arrangements 10/10'. For example, if one requires two individual planter packaging arrangements 10/10', one may insert fingers/hands/or other grasping arrangement into the grasping element 36' of individual planter packaging arrangement 10', beneath individual planter packaging arrangement 10 and lift those two simultaneously off the stack of the remaining individual planter packaging arrangements and transport them. The nesting arrangement secures the two individual planter packaging arrangements together. In contrast, lifting multiple prior art arrangements can be cumbersome and/or difficult, especially as the boxes are not secured together and must be carefully balanced or the top boxes 500' may become dislodged and separated from a bottom box 500".

As planters 12 are often made of ceramic material that may be prone to starching or other surface damage, it is contemplated that after a stack is formed, an anti-abrasion bag or plastic may encircle the completed stack. Alternatively, each planter 12 may be encased in an anti-abrasion material, such as a plastic wrap before being mounted in the packaging element 14.

In another exemplary arrangement, instead of a single planter 12, the sidewalls 30 may be sized to permit a stack of nested planters 12 disposed within a single packaging element 14. An anti-abrasion material, such as a polymeric bag may encircle the stack of nested planters 12 before the planters 12 are disposed within the packaging element 14. With this arrangement, even more planters may be packaged together.

Referring to FIGS. 7A-13, an alternative planter packaging arrangement 100 is shown. The planter packaging arrangement 100 includes at least one planter 12 partially mounted in a packaging element 114. In the exemplary arrangement shown in FIGS. 7A-B, a stack of planters 112 is partially mounted in the packaging element 114. Each planter 12 is similar to the planter 12 that shown in FIG. 3. More specifically, each planter is defined by a generally closed bottom surface 16, a top edge 18 (shown in phantom in FIG. 3) extending around an open top end 20 and a body portion 22 extending between the bottom surface 16 and the open top end 20. The bottom surface 16 is configured with a cross-sectional area that is smaller than a cross-sectional area of the open top end 20. In this manner, the body portion 22 flares or tapers outwardly from the bottom surface 16 to the open top end 20. The body portion 22 may include an outer rim element 24 disposed on an outer surface of the body portion 22 that extends from open top end 20. Alternatively, the top edge 18 may flare outwardly from the body portion 22, similar to a bell.

Figure 7A:
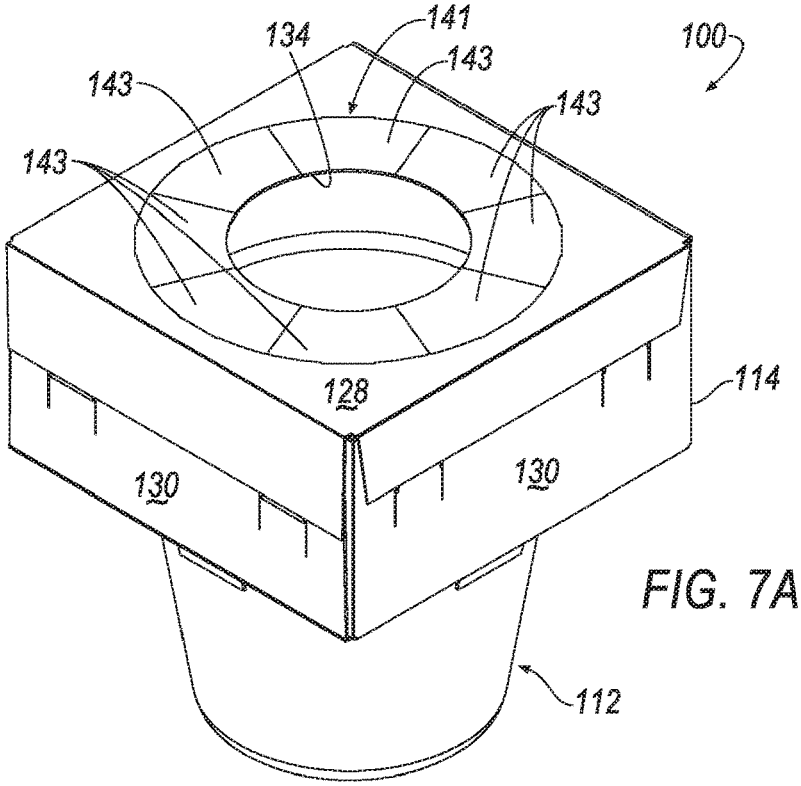
FIG. 7A is a bottom perspective view of an alternative configuration of a planter packaging arrangement.
Figure 7B:
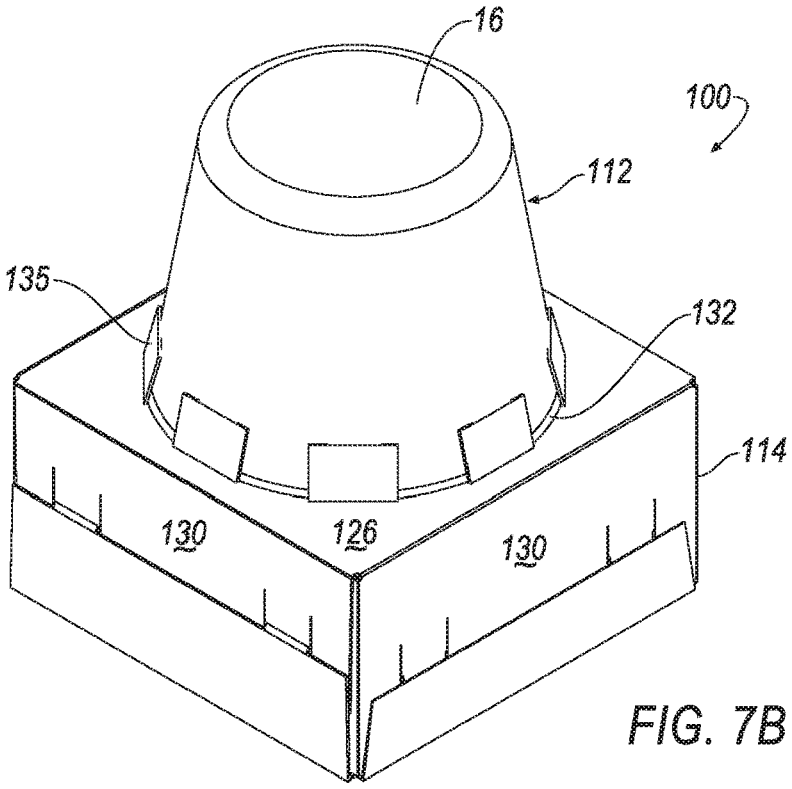
FIG. 7B is a top perspective view of the planter packaging arrangement of FIG. 7A.
Figure 8:
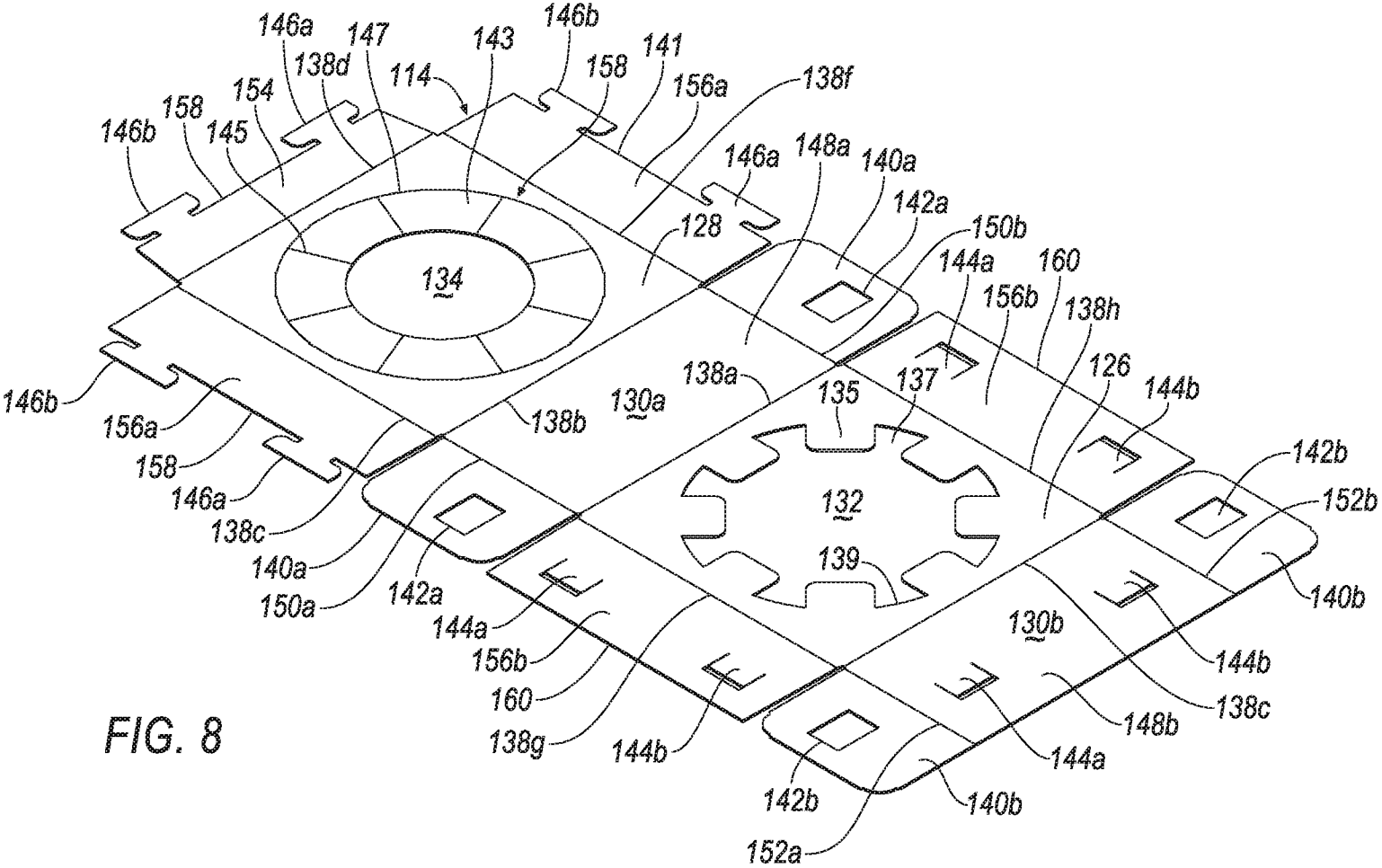
FIG. 8 is a perspective view of a packaging element in an initial unformed configuration.
Figure 9:
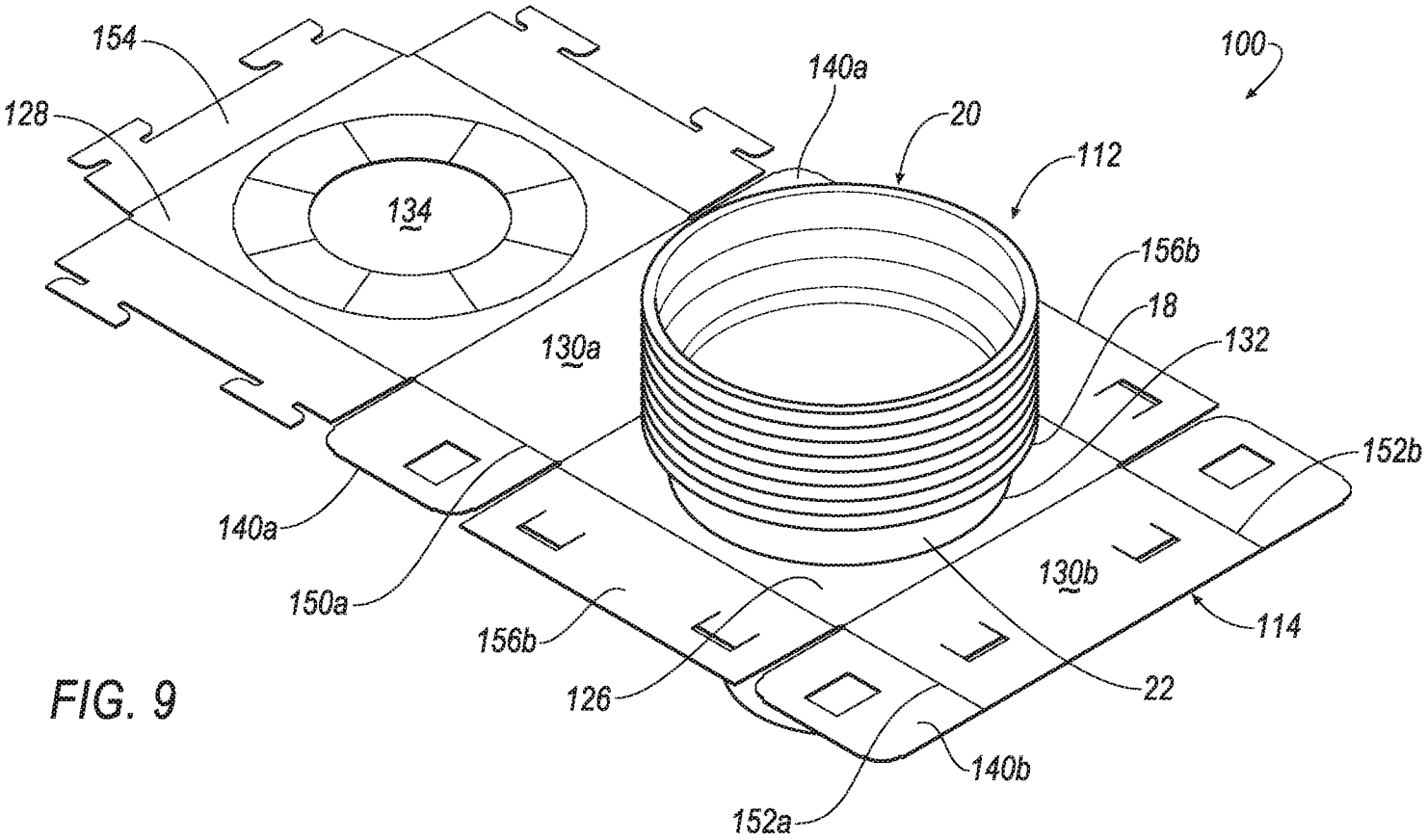
FIG. 9 is a perspective view of the packaging element in the initial unformed configuration with a planter stack partially mounted within the packaging element.

The packaging element 114 is defined by spaced apart generally opposing first 126 and second 128 surfaces that are joined together by four sidewalls 130. In one exemplary arrangement, portions of the sidewalls 130 may be integral with the top 126 and bottom 128 portions, as illustrated in FIGS. 8-9. The first surface 126 includes a first opening 132 disposed therethrough. The second surface 128 includes a second opening 134 disposed therethrough. When the packaging element 114 is positioned in an assembled configuration, such as that shown in FIGS. 7A-7B, the first and second openings 132, 134 are generally aligned such that a central axis extends through a center of both first and second openings 132, 134.

The first opening 132 is defined with a plurality of tabs 135 and recesses 137 extending around the periphery 139 of the first opening 132. In one exemplary arrangement, the tabs 135 are configured with a generally rectangular shape. In one exemplary arrangement, the recesses 137 are configured with a generally trapezoidal shape. Operation of the tabs 135 will be explained in further detail below.

The second opening 134 is defined with an outer ring 141 surrounding the opening 134. Outer ring 141 is made up of a plurality of joined segments 143. The segments 143 are joined together by a perforated segment 145 that starts at opening 134 and terminated at the outer periphery 147 of outer ring 141. Operation of the joined segments 143 will be explained in further detail below.

In one exemplary arrangement, side walls 130 are formed of multiple sidewall elements that interconnect to form the side walls 130. For example, referring to FIGS. 8 and 9, a center sidewall **130*a* is positioned between first and second surfaces 126, 128. Where center sidewall 130*a* joins first surface 126 there is a first fold line 138*a*. Where center sidewall 130*a* joins bottom surface there is a second fold line 138*b*. Center sidewall 130*a* further includes first end center connectors 140*a* that include a first connection center element 142*a* that cooperates with a second and third connection elements 144*a*, 146*a*, as will be explained in further detail below. First end center connectors 140*a* are attached to a central portion 148*a* of center sidewall 130*a* along end connector fold lines 150*a*, 150*b***, respectfully.

End sidewall **130*b* is attached to first surface 126 by third fold line 138*c* opposite first fold line 138*a*. End sidewall 130*b* further includes second end connectors 140*b* that each include the second connection elements 142*b* that cooperate with second and third connection elements 144*b*, 146*b*, as will be explained in further detail below. Second end connectors 140*b* are attached to a central portion 148*b* of end sidewall 130*b* along end connector fold lines 152*a*, 152*b***, respectfully.

A lateral connector 154 is attached to second surface 128 by a fourth fold line **138*d*, opposite first fold line 138*a*. Lateral connector 154 carries third connection elements 146*a*, 146*b*. Extending along opposing edges of second surface 128 are side connectors 156*a*. First side connectors 156*a* are connected to second surface 128 by fold lines 138*e* and 138*f*. First side connectors 156*a* each carry third connection elements 146*a*, 146*b*. Connector elements 146*a*, 146*b* extends outwardly from and edge 158 of lateral and first side connectors 154, 156*a***.

Second side connectors **156*b* are connected to first surface 126 by fold lines 138*g* and 138*h*. Second side connectors each carry second connection elements 144*a*, 144*b*. Second connection elements 144***a*, 144*b* are positioned inbound of an outer edge 160 of second side connectors 156*b*.

Figure 10B:
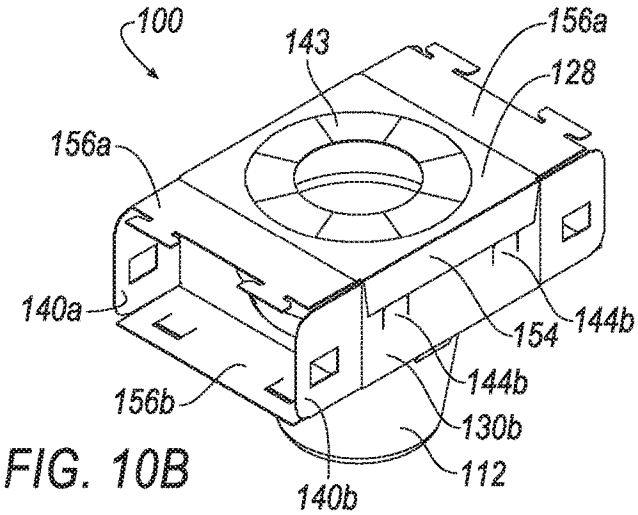
FIG. 10B is a perspective view of the packaging element in a second partially assembled configuration.
Figure 10A:
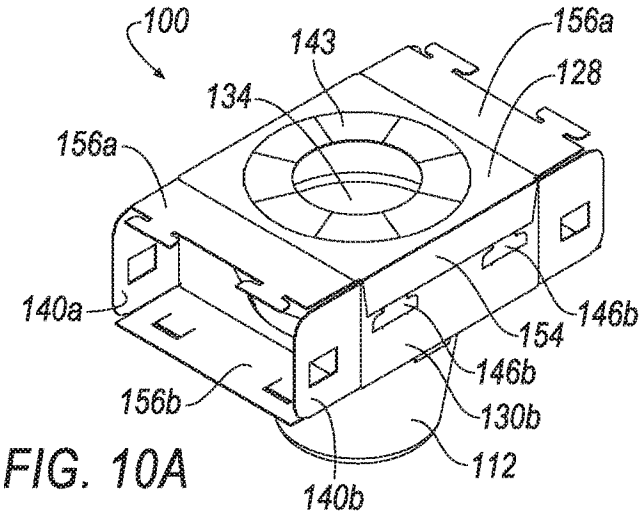
FIG. 10A is a perspective view of the packaging element in a first partially assembled configuration.
Figure 10D:
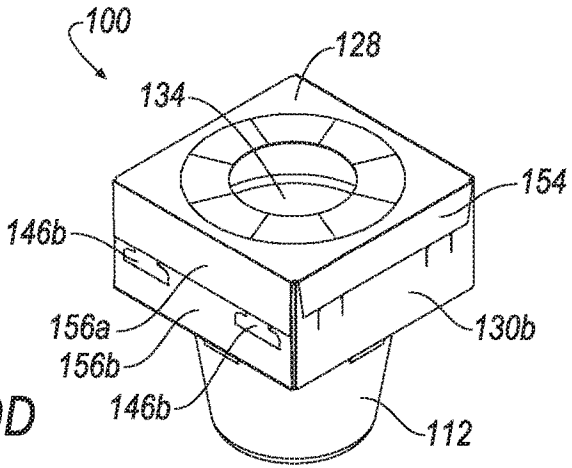
FIG. 10D is a perspective view of the packaging element in a fourth partially assembled configuration.

Referring to FIGS. 9-10D, assembly of the planter packaging arrangement 100 will now be described. Assembly of planter packaging arrangement 100 may begin with the packaging element 114 in an initial unformed configuration that is generally planar, as shown in FIGS. 8 and 9. This configuration allows for easy storage of the packaging element 114 until needed, as well as efficient shipment of the packaging element 114, as all the packaging elements 114 may be stacked together until needed.

Figure 11A:
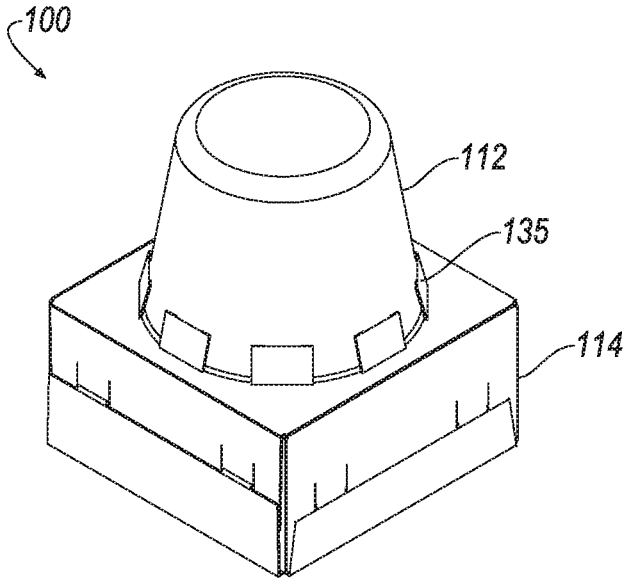
FIG. 11A is a perspective view of the fully assembled packaging element with the planter stack disposed within the packaging element.
Figure 11B:
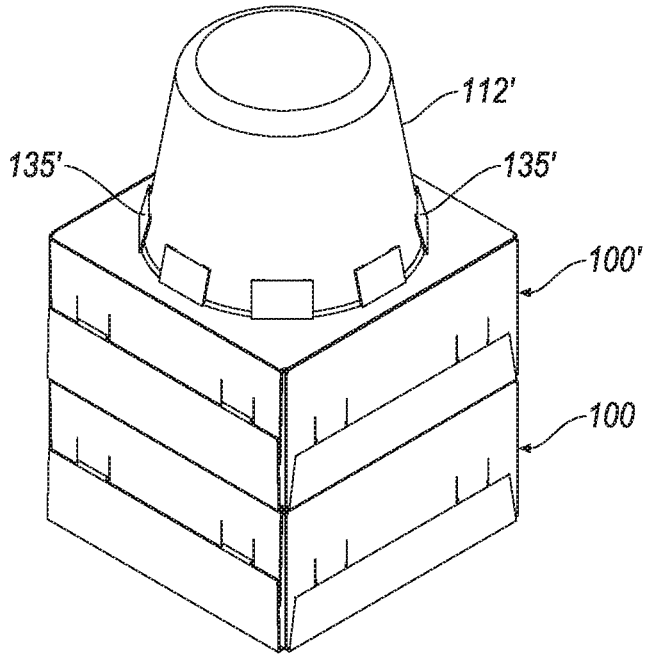
FIG. 11B is a perspective view of multiple packaging elements with successive planter stacks disposed within the packaging elements stored together.

When it is desired to use the packaging elements 114 with planters 12, a stack of planters 112 are nested together, as shown in FIG. 9. In one exemplary arrangement, the stack of nested planters 112 are then encased in an anti-abrasion material, such a polymeric bag, which may encircle the stack of nested planters. The stack of nested planters 112 are then positioned through the first opening 132, with the bottom surface 16 of the lowermost planter 12 (lowermost being defined when the stack of planters 112 are arranged with the open top ends facing down) in the stack being directed through the first opening 132. The top edge 18 of the lowermost planter 12 is slightly larger than the periphery 139 of the first opening 132 (defined by the depth of recesses 137) such that the top edge 18 rests against the first surface 126. During insertion of the stack of planters 112, the tabs 135 are forced to flex to extend along an outer surface of the body portion 22 of the lowermost planter 112, as shown in FIGS. 7B and 11B. The tabs 135 exerts a slight compressive force on the outer surface of the lowermost planter 112 to provide stability of the planters 112 within the packaging element 114.

Once the planters 112 are positioned, the sidewall 130*a* is pivoted along fold line 138*a* such that the center sidewall 130*a* is oriented upwardly with respect to the first surface 126 (i.e., generally perpendicular to a plane in which the first surface 126 lies). Next, the second surface 128 is pivoted along fold line 138*b* such that second surface 128 overlies first surface 126 (i.e., so as to be generally parallel t the first surface 126) and first opening 132 is aligned with second opening 134, as shown in FIG. 10A. End sidewall 130*b* is pivoted along fold line 138*c* toward center sidewall 130*a* so as to be disposed generally parallel to the center sidewall 130*a*. The third connection elements 146*a*, 146*b* are mated with cooperating connection elements second connection elements 144*a*, 144*b*. In one exemplary arrangement, third connection elements 146*a*, 146*b* are configured as tab members and the second connection elements 144*a*, 144*b* are configured as detent members. With this arrangement, the third connection elements 146*a*, 146*b* force the second connection elements 144*a*, 144*b* inwardly, with ends of the third connection elements 146*a*, 146*b* being disposed against an inner surface of the sidewall 130*b*. In this manner, the second surface 126 is secured in position with respect to the first surface 124, as shown in FIG. 10B.

Figure 10C:
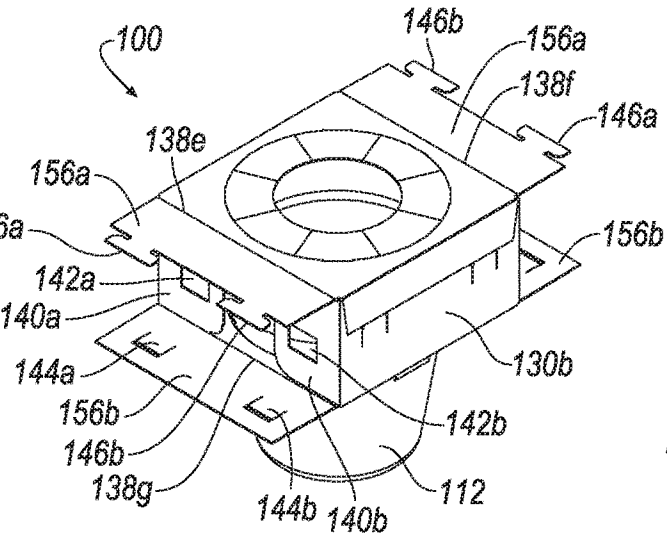
FIG. 10C is a perspective view of the packaging element in a third partially assembled configuration.

Next, referring to FIG. 10C, the first and second end connectors 140*a* and 140*b* bent toward each other about fold lines 150*a*, 150*b*, 152*a*, and 152*b*, respectively. The second side connectors 156*b* are bent upwardly along fold lines 138*g* and 138*h*, respectively to overlay the first and second end connectors 140*a*, 140*b*. The first side connectors 156*a* are bent downwardly along fold lines 138*e* and 138*f*, respectively to overlay the second side connectors 156*b* respectively, as shown in FIG. 10D. Once the end connectors and first and second side connectors are positioned in this manner, these elements are secured together. For example, the second connection elements 144*a*, 144*b* are pushed into the first connection elements 142*a*, 142*b*, which are configured as connection openings. Next, the third connection elements 146*a*, 146*b* are disposed through the first connection elements 142, 142*b*, which positions ends of the third connection elements 142, 142*b* in frictional engagement against an inside surface of the first and second end connectors 140*a*, 140*b*. With this configuration, the top edges 18 of the planters 112 are enclosed within the packaging element 114, as shown in FIG. 11A to form the planter packaging arrangement.

Second connection elements 144*b* may also function as grasping element. More specifically, second connection elements 144*b* may be pressed inwardly and sized to receiving fingers or other grasping elements to lift one or more packaging arrangements.

Much like the arrangement shown in FIG. 6, the planter packaging arrangement 100 is configured to permit selective stacking of successive planter packaging arrangements 100. More specifically, referring to FIG. 11B, a second planter packaging arrangement 100' is disposed over a first planter packaging arrangement 100. The bottom surface 16 of the planter 112 for the first planter packaging arrangement 100 extends through the second opening 134 of the individual planter packaging arrangement 100' to nest within the body portion 22 of the planter 112 of the first individual packaging arrangement 100, as demonstrated in FIG. 12A. The joined segments 143 surrounding the second opening 134 will separate along perforated lines 145 to serves as a stabilizing element on both the inside surface of the body portion 22' of the lowermost planter 112' of the second planter packaging arrangement 100', as well as serving as a stabilizing element on the outside surface of the body portion 22 of the uppermost planter 112 of the first planter packaging arrangement 100. As may be seen, additional planter packaging arrangements may be stacked together to create a column.

Figure 12A:
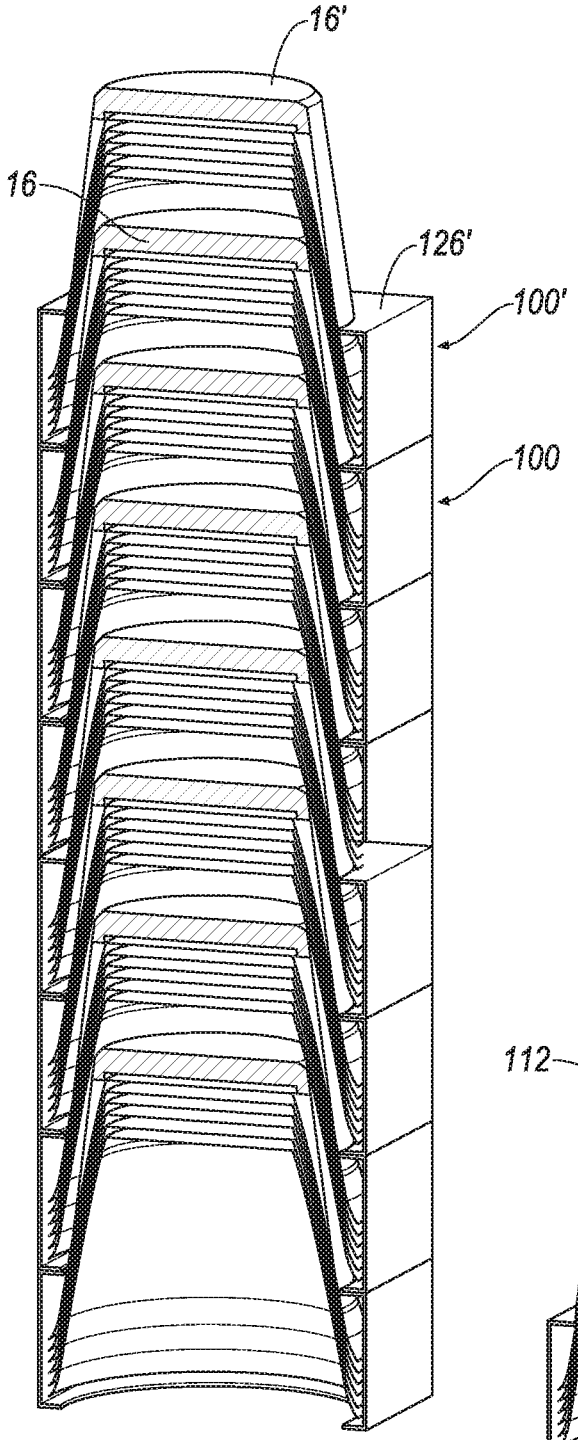
FIG. 12A is a cross-sectional view of a stack of multiple packaging arrangements.
Figure 12B:
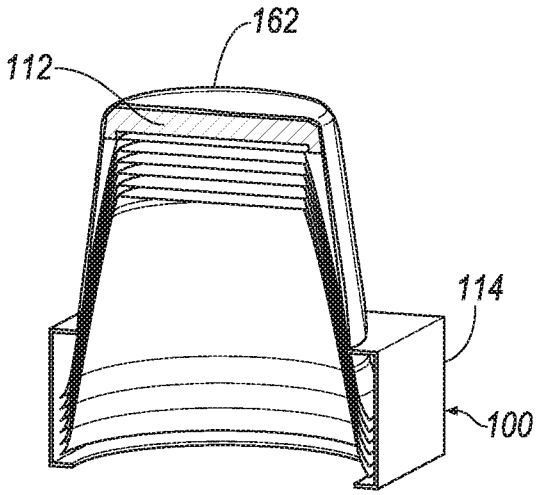
FIG. 12B is a cross-sectional view of the packaging arrangement of FIGS. 7A and 7B with a protective cover thereon.
Figure 13:
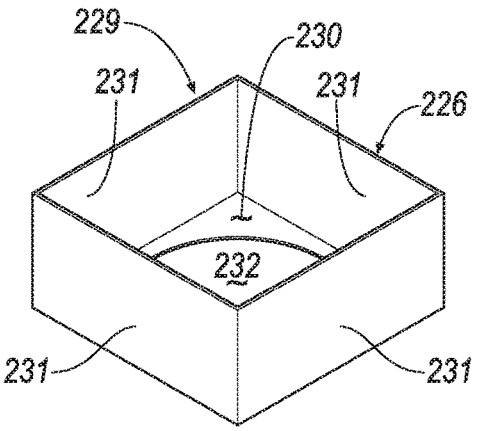
FIG. 13 is a perspective view of a first element of an alternative packaging arrangement.
Figure 14:
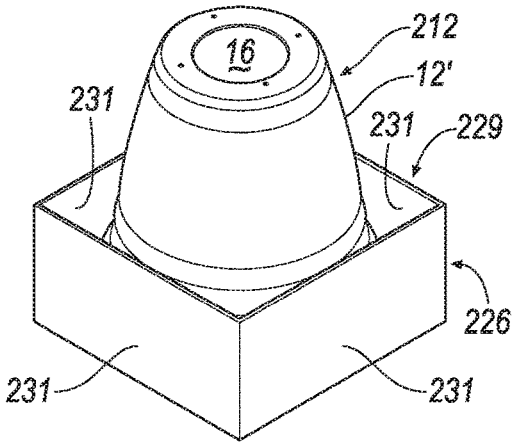
FIG. 14 is a perspective view of a planter stack disposed within the first element of the packaging arrangement of FIG. 13.
Figure 15:
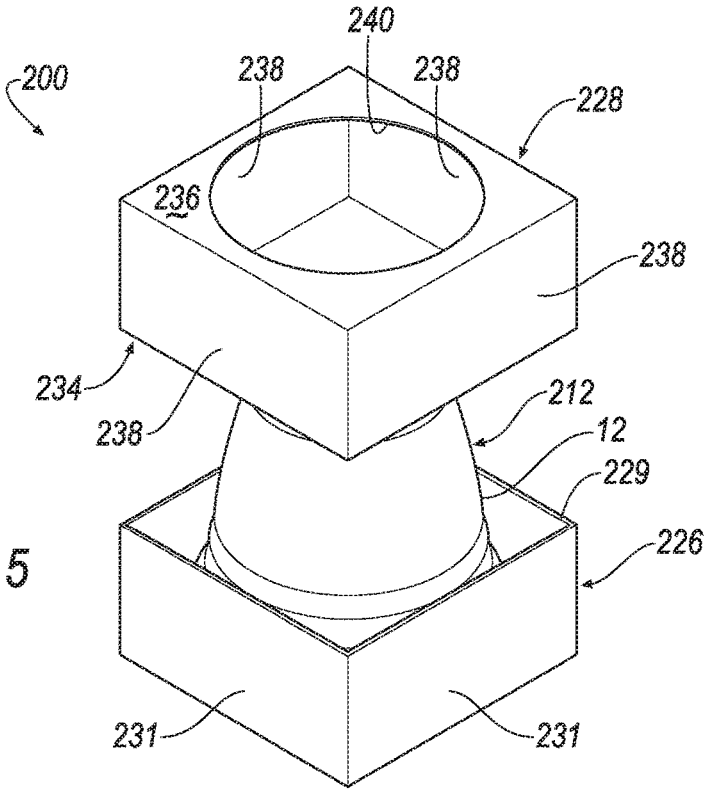
FIG. 15 is a partially exploded view of the alternative packaging arrangement illustrating a second element that is disposable over the first element of the packaging arrangement of FIG. 15.
Figure 16:
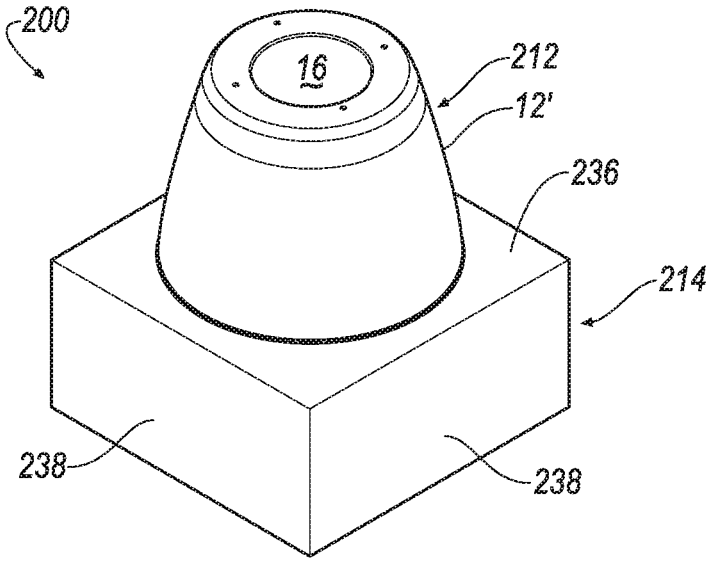
FIG. 16 is a perspective view of the assembled alternative packaging arrangement.
Figure 17:
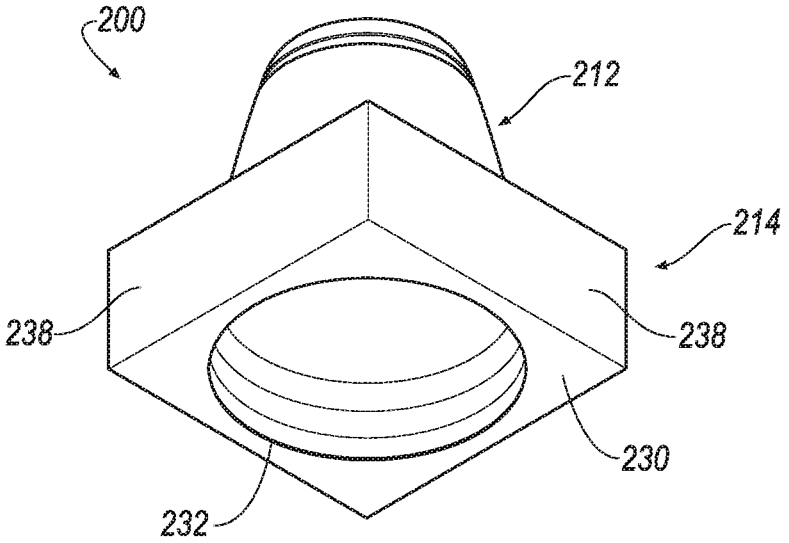
FIG. 17 is a bottom perspective view of the assembled alternative packaging arrangement of FIG. 16.

As discussed above, each stack of planters 112 may be enclosed in an anti-abrasive covering, such as a such as a polymeric bag 162 to protect against damage, as shown in FIG. 12B.

Referring to FIGS. 13-17, a third planter packaging arrangement 200 is shown. Planter packaging arrangement 200 includes at least one planter 12 partially mounted in a packaging element 214. In the exemplary arrangement shown in FIGS. 13-17, a stack of planters 212 are partially mounted in the packaging element 214. Each individual planter in the stack of planters 212 is similar to the planter 12 that shown in FIG. 3 and described above. While not shown in this particular arrangement, the stack of planters 212 may also be enclosed in an anti-abrasive material, such as polymeric bag 162.

The packaging element 214 is defined by a first element 226 and a second element 228 that may be selectively joined together to define packaging element 214. In one exemplary arrangement, the first element 226 is configured with an open top 229, a bottom surface 230, and four side walls 231 extending upwardly from the bottom surface 230. Bottom surface 230 further includes a first opening 232 extending therethrough. First opening 232 is sized to be smaller than the outer periphery defined by the top edge 18 of the lowermost planter 12 in the planter stack 212.

Second element 228 generally corresponds to the first element 226. More specifically, second element 228 includes an open bottom 234, a top surface 236, and four side walls 238 extending downwardly from the top surface 236. Top surface 236 further includes a second opening 240 extending therethrough. Second opening 240 is also sized to be smaller than the outer periphery defined by the top edge 18 of planter 12. The four side walls 231, 238 may be integral with the top 236 and bottom 230 portions, respectively. When the packaging element 214 is positioned in an assembled configuration, such as that shown in FIGS. 15-17, the first and second openings 232, 240 are generally aligned such that a central axis extends through a center of both first and second openings 232, 240.

To assemble planter packaging arrangement 200, the planter stack 212 is positioned within the first element 226 with the planter stack 212 being positioned with the open top end 20 facing downwardly on to the bottom surface 230 of the first element 226, surrounding the first opening 232. The first opening 232 provides access to the interior of the bottom-most planter 12 within the planter stack 212.

Once positioned, the second element 228 is disposed over the bottom end 16 of the uppermost planter 12' in the planter stack 212 such that the bottom end 16 of the planter stack 212 extends through the second opening 240. The side walls 238 of the second element 228 are then slid over on top of the four side walls 231 of the first element 226 to lock the top edges 18 of the planter stack 212 within the packaging element 214.

However, like the packaging arrangements 14 and 114, the packaging element 214 provides for an opening 232 at the bottom of the packaging 214 that is allows for a second stack of planters (not shown) to be nested therewithin, in a similar manner as that shown in FIG. 12A.

While not shown, it is also understood that packaging element 214 may include one or more grasping elements, such as that shown in connection with packaging arrangements 14 and 114.

It is to be understood that the above description is intended to be illustrative and not restrictive. Many embodiments and applications other than the examples provided would be apparent upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A planter packaging arrangement, comprising:

a packaging element defined by a first element and a second element;

the first element is defined by a bottom surface, and two pairs of opposing side walls that extend upwardly from the bottom surface and define a generally open top surface, the bottom surface further defines a first opening therethrough;

the second element is defined by a top surface and two pairs of opposing side walls that extend downwardly from the top surface and define a generally open bottom surface, the top surface further defines a second opening therethrough; and at least one planter mounted within the first element, the planter defined by a bottom surface, an open top end and a body portion therebetween;

wherein the open top end of the at least one planter is disposed within the first element of the packaging element with the open top end of the at least one planter aligned with the first opening such that an interior of the at least one planter is accessible through the first opening of the bottom surface of the first packaging element, and wherein the second element is connected to the first element such that a portion of the body portion of the at least one planter extends through the second opening of the top surface of the packaging element such that the bottom surface of the at least one planter is disposed above the top surface of the second packaging element; and wherein the second opening is smaller than the first opening.

2. The planter packaging arrangement of claim 1, wherein one pair of the pairs of opposing side walls of the first element or the second element include a grasping element.

3. The planter packaging arrangement of claim 1, wherein the planter packaging arrangement includes a stack of planters that are mounted within the first element, in a nested configuration.

4. The planter packaging arrangement of claim 1, wherein the packaging element and planter mounted therein are stacked on top of a second packaging element and a second planter identical to the packaging element and planter such that a bottom surface of the second planter is received within the interior of the planter such that a body portion of the second planter is nested within the interior of the planter and the bottom surface of the packaging element rests against the top surface of the second packaging element.

5. The planter packaging element of claim 1, wherein the second element is disposed over the first element such that the side walls of the second element surround the side walls of the first element.

6. The planter packaging element of claim 1, further comprising a protective covering enclosing the planter.

7. The planter packaging arrangement of claim 1, wherein the packaging element comprises a unitary packaging element defined by the first element and the second element joined together by one of the side walls; and wherein the second element of the packaging element is selectively pivotable about the side wall such that the first element is parallel to the second element, and wherein the second element is connected to the first element to capture the open top end of the at least one planter within an interior defined by the packaging element.

8. The planter packaging element of claim 7, wherein the planter packaging arrangement includes a stack of planters that are mounted within the first element, in a nested configuration.

9. The planter packaging element of claim 7, wherein the first opening is defined by a periphery constructed defined by recesses alternated with tabs, wherein when the at least one planter is disposed within the first element of the packaging element, the tabs bend with respect to the first element to engage against the body portion of the at least one planter.

10. The planter packaging element of claim 9, wherein the tabs have a generally rectangular shape and the recesses have a generally trapezoidal shape.

11. The planter packaging element of claim 7, wherein the second element includes a selectively deformable outer ring surrounding the second opening.

12. The planter packaging element of claim 11, wherein the outer ring further comprises a plurality of segments that are joined together by perforation lines radially extending from second opening.

13. The planter packaging element of claim 7, wherein the unitary packaging element further comprises a center side wall element and an end side wall element, the center side wall element joining the first and second elements, the end side wall element joined to the first element.

14. The planter packaging element of claim 13, wherein the unitary packaging element further comprises a lateral connector joined to the second element, wherein the lateral connector further includes at least one lateral connection element that cooperates with a corresponding end connection element to secure the first and second elements in a spaced apart and parallel arrangement, with the first open top end of the at least one planter disposed therebetween.

15. The planter packaging element of claim 14, wherein the first element further includes a pair of first side connectors disposed on either side of the first element, each of the pair of first side connectors having first side connection elements disposed thereon, and wherein the second element further includes a pair of second side connectors disposed on either side of the second element, each of the pair of second side connectors having second side connection elements disposed thereon, wherein the pair of second side connectors engage with the corresponding pair of first side connectors to secure the first and second elements in a spaced apart and parallel arrangement, with the first open top end of the at least one planter disposed therein.

16. The planter packaging element of claim 15, wherein the center side wall element further includes a pair of center end connectors disposed on either side of the center side wall element and wherein the end side wall element further includes a pair of end connectors disposed on either side of the end side wall element, wherein the center end connectors and the end connectors are selectively pivotable with respect to the center side wall element and the end side wall element respectively.

17. The planter packaging element of claim 16, wherein each of the center end connectors and end connectors further includes connection apertures, wherein the first and second side connectors are engaged with the connection apertures to secure the first and second elements in a spaced apart and parallel arrangement, with the first open top end of the at least one planter disposed therein.

18. The planter packaging element of claim 7, further comprising an anti-abrasive material surrounding the at least one planter.

19. The planter packaging arrangement of claim 1, wherein the packaging element first surface and the second surface are arranged parallel to each other in a spaced apart manner;

wherein the first surface is joined to the second surface by at least one common side wall that extends generally perpendicular to the first and second surfaces, wherein the first and second surfaces cooperate with the common side wall and three additional side walls to define a cavity into which an open end of at least one planter is captured;

wherein the second surface is selectively pivotable with respect to the first surface to permit the at least one planter to be disposed within the cavity, the planter defined by a bottom surface, an open top end and a body portion therebetween; and wherein the open top end of the at least one planter is aligned with the first opening once the second surface is pivoted back to be parallel to the first surface such that an interior of the at least one planter is accessible through the first opening of the bottom surface of the first packaging element.

* * * * *